US005438716A

United States Patent [19]

Dabney

[11] Patent Number: 5,438,716

[45] Date of Patent: Aug. 8, 1995

[54] BOX SPRING ASSEMBLY WITH IMPROVED SPRING INSTALLATION CAPABILITIES

[75] Inventor: Upton R. Dabney, Lexington, Ky.

[73] Assignee: Hoover Group, Inc., Alpharetta, Ga.

[21] Appl. No.: 133,910

[22] Filed: Oct. 12, 1993

[51] Int. Cl.[6] ..... A47C 23/04; A47C 23/053

[52] U.S. Cl. ..... 5/247; 5/267; 267/103; 29/91.1

[58] Field of Search ..... 5/247, 239, 255, 267, 5/476; 267/103, 107, 110; 29/91.1, 91

[56] References Cited

U.S. PATENT DOCUMENTS 5,142,715 9/1992 Ogle et al. ..... 5/247
5,142,716 9/1992 Ogle et al. ..... 5/247
5,197,155 3/1993 Ogle et al. ..... 5/247

*Primary Examiner*—Alexander Grosz

*Attorney, Agent, or Firm*—Harness, Dickey & Pierce

[57] ABSTRACT

A box spring assembly having a support deck, a frame and support springs. The deck includes a border wire, long wires extending longitudinally and cross wires extending transversely. Support springs are mounted between the frame and the deck to yieldably support the deck above the frame. The support springs each include a pair of yieldable portions extending between the frame and deck and a deck attaching portion extending between upper ends of said yieldable portions. The deck attaching portion has end bars longitudinally extending from each of the yieldable portions and a cross bar transversely extending between the end bars. The deck attaching portion is configured to engage a cross wire of the deck in an interwoven fashion in response to axial movement of the entire support spring relative to the deck thereby clamping the spring module to the deck.

16 Claims, 2 Drawing Sheets

BOX SPRING ASSEMBLY WITH IMPROVED SPRING INSTALLATION CAPABILITIES

BACKGROUND AND SUMMARY OF THE INVENTION

This invention relates generally to mattress foundation structures utilizing non-coil springs. More particularly, this invention relates to a non-coil box spring assembly having spring modules with improved spring installation capabilities.

Box spring assemblies using non-coil support springs or spring modules have been known since about 1964, the first such spring assembly known to Applicant was disclosed in U.S. Pat. No. 3,286,281. Box spring assembles of this general type are advantageous (with respect to conventional coil box spring assemblies) because they provide a stiffer foundation for the mattress and contain a reduced amount of spring wire. Additionally, these non-coil box spring assemblies offer prolonged service life, easy assembly and reduced manufacturing costs.

Mattress foundation structures which use non-springs, often referred to as wire forms, offer still further increases in stiffness and support, especially around the perimeter of the foundation structure. The stiff perimeter prevents significant localized deflection of the mattress and foundation structure when a person is sitting on the edge of the bed. This eliminates the "sliding off" feeling typically associated with less stiff or soft mattress and box spring assemblies.

While wire form mattress foundation structures exhibit benefits with respect to perimeter stiffness, they also are inherently limited as a result of their increased stiffness. While not apparent during normal use conditions, this limitation arises under "normal" abuse conditions such as sudden impact loads resulting from a person jumping, diving or falling onto the bed. The increased load applied to the foundation structure under such a condition, coupled with the limited deformation resistance of the wire form itself, often results in the wire form becoming permanently set and damaged.

Both non-coil spring modules and wire forms are mounted (hereinafter referred to as spring modules) so that they support a wire grid or support deck above a frame. These three elements (the deck, the spring modules and the frame) make up the principal components of a box spring assembly. Two methods are generally used to attach the spring modules to the deck.

In the first method, self-securing clips extend around portions of both the deck and the spring module to hold them together. Use of the clips, however, is labor intensive and adds numerous parts to the overall assembly since each spring module typically requires at least two clips. Another inconvenience is that the clips further increase the inventory which must be kept on hand at the production facility.

The second method generally used to secure spring modules to the support deck involves interweaving a deck attaching portion of the spring module with the wires of the support deck. When interwoven in this fashion a long or cross wire extends over and under several portions of the deck attaching portion. To attach a spring module in this manner, the downwardly extending or yieldable portions of the spring module are positioned on opposite sides of one cross wire so that the deck attaching portion extends generally diagonally across at least two of the long wires and the cross wire. The spring module is then rotated about a vertical axis to bring the end sections of the deck attaching portion beneath the cross wire. This effectively clamps the spring module onto the cross wire. The securement is called "interwoven" since the cross wire extends over one end, under a middle section and over the other end of the deck attaching portion. Because of the diagonal initial mounting, it is often initially necessary for the yieldable portions of the spring module to be spread outwardly to allow the spring module to fit diagonally over the required number of long wires.

It is an object of the present invention to simplify the installation of spring modules into a box spring assembly. Installation is improved by eliminating the use of clips and the need for the spring module to be rotated so as to achieve the interwoven attachment as mentioned above. A related object of the present invention is to provide a spring module with a construction that allows the spring module to attach to the deck through a simplified, axial movement of the entire module.

It is also an object of the present invention to provide a box spring assembly which simulates a non-spring mattress foundation structure in terms of effective firmness while improving deformation resistance in the spring module.

In achieving the above and other objects, the present invention provides a box spring assembly having a rectangular frame made up of side rails, end rails and a plurality of cross rails. The cross rails are generally parallel to each other and the end rails and are substantially perpendicular to the side rails. A welded wire grid or support deck is supported, generally horizontally, a predetermined distance above the frame. The support deck includes a border wire that defines the perimeter of the deck and a number of straight wires, some of which extend lengthwise of the frame and others of which extend crosswise of the frame.

To yieldably support the deck above the frame, a number of unitarily formed support springs or modules extend between the deck and the frame. Each of the support springs is formed of spring wire and has a body made up of two side-by-side yieldable sections. While they may have a variety of configurations, in the illustrated embodiment the yieldable sections each include coaxial upper and lower column portions which are connected together by a middle portion. The configuration of the middle portion allows the yieldable section to bend in a substantially vertical plane in response to loads applied to the assembly. This deformation provides the box spring assembly with the desired amount of deformation resistance. In preferred form, the middle portions are arcuate and generally semi-circular in shape. This avoids any areas of stress concentration that might weaken the support springs during repeated response to applied loads and enables the support spring to resist normal abuse conditions without developing a permanent set.

The two yieldable sections of each support spring are connected together at their upper ends by a deck attaching section which coacts with at least one of the straight wires to secure the support spring to the support deck. The deck attaching section includes a pair of end bars which are interconnected by a cross bar that extends between immediately opposing ends of the end bars. The cross bar is provided with an axial extension, generally in its middle, that has a length about the same as that of the end bars. The extension extends from the cross bar in the same direction as the end bars.

To mount the support spring of the present invention to the support deck, the support spring is positioned to one side of a crosswise straight wire so that the deck attaching portion spans a number of the lengthwise straight wires. The entire support spring is then moved in an axial direction along the support deck so that both of the end bars are positioned beneath the crosswise straight wire. The middle extension of the cross bar remains positioned across the top of the crosswise straight wire thereby clamping the support spring to the deck and achieving the interwoven construction mentioned above.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE PREFERRED EMBODIMENTS

Figure 1:
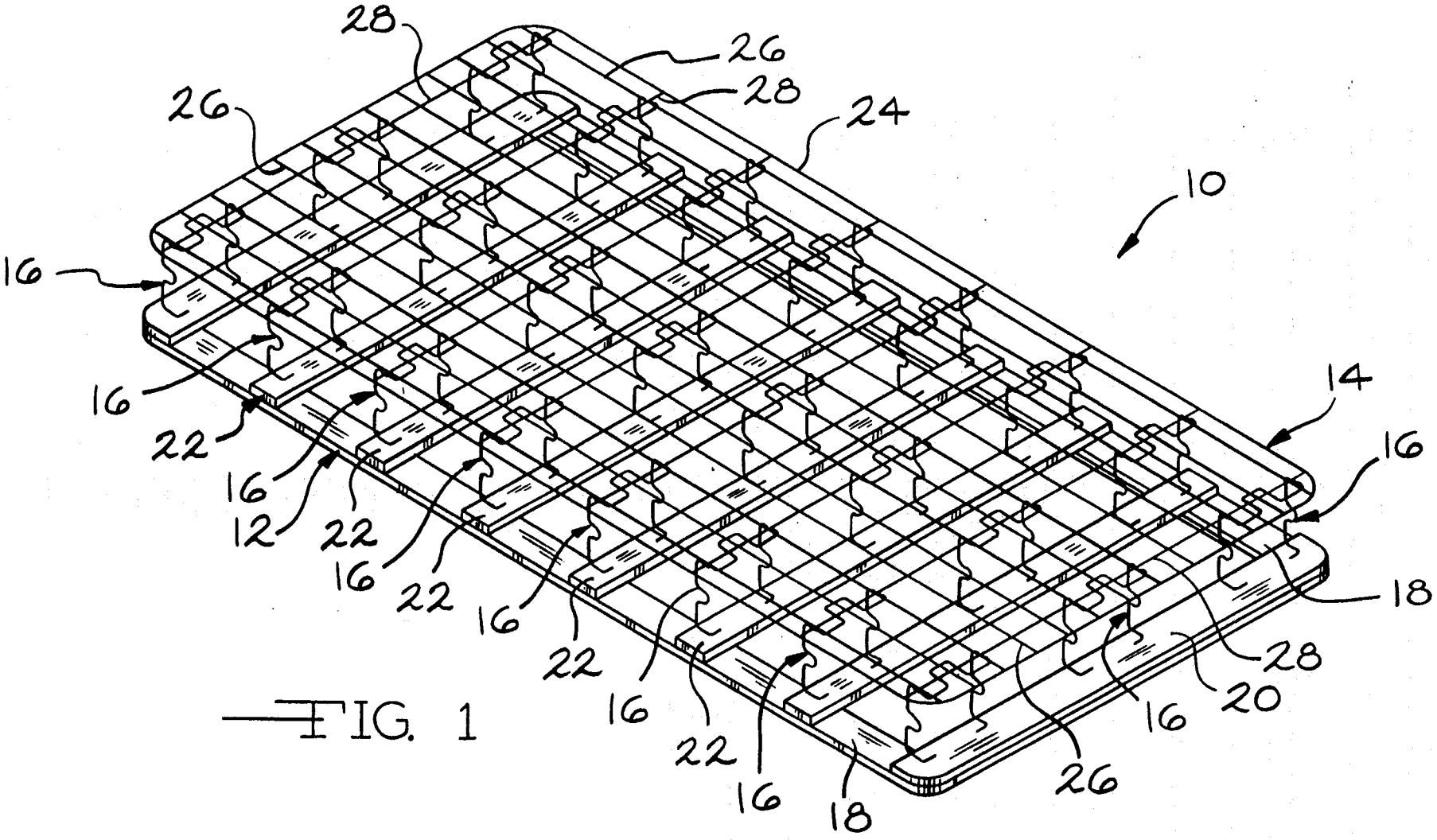
FIG. 1 is a perspective view of a box spring assembly embodying the principles of the present invention.

Referring now to the drawing, a box spring assembly according to the principles of this invention is illustrated in FIG. 1 and generally designated at 10. The box spring assembly 10 principally consists of a frame 12, a support deck 14 and a plurality of spring modules or support springs 16.

The frame 12 is generally a horizontally disposed structure that includes side rails 18 and end rails 20 which define its substantially rectangular shape. Between the two end rails 20, a plurality of substantially parallel cross rails 22 extend across and are secured to the side rails 16. Typically, the frame 12 is constructed of wood. However, an all metal or composite frame could be used as an alternative to the illustrated embodiment.

As mentioned above, the support deck 14 is generally horizontally supported by the springs 16 a predetermined distance above the frame 12. The deck 14 consists of a border wire 24 and a plurality of straight wires arranged in a criss-cross fashion. The border wire 24 defines the perimeter of the deck 14 and has a generally rectangular shape that corresponds with the shape and perimeter of the frame 12. Supported by the border wire 24, the straight wires include long wires 26, which extend lengthwise of the frame 12, and cross wires 28, which extend crosswise of the frame 12.

While not specifically necessary, it is preferred that the border wire 24, long wires 26 and cross wires 28 of the deck 14 are welded together at all intersections therebetween to form a welded wire grid. This is desirable since it eliminates the noise created when nonwelded overlapping wires rub against each other during deflection of the support springs 16. Obviously, alternate constructions of the deck 14 could be utilized.

Figure 2:
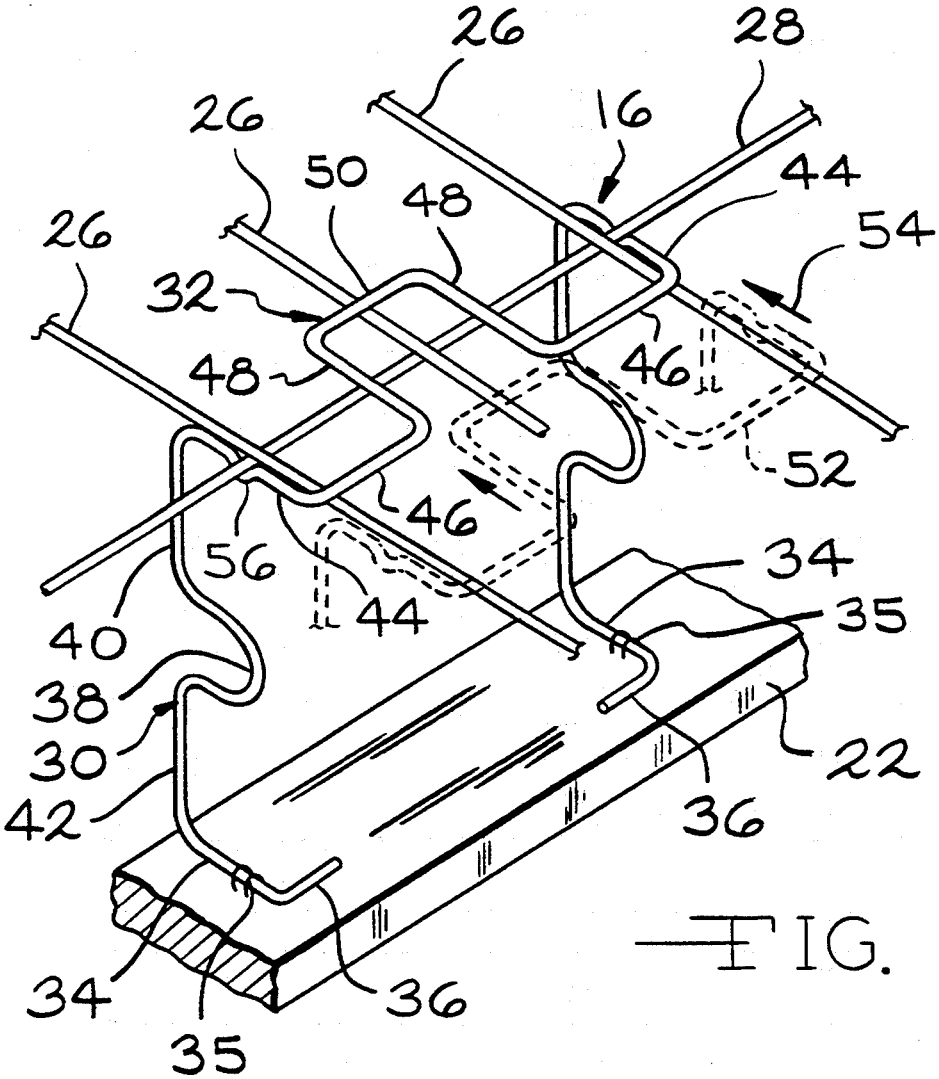
FIG. 2 is a perspective view of a support spring according to the present invention incorporated between a support deck and a frame.

Referring now to FIG. 2, one embodiment of a spring 16 incorporating the principles of the present invention is shown. The spring 16 is unitarily formed from a length of steel spring wire which is bent to form a body having a pair of side-by-side yieldable sections 30 connected together at their upper ends by a deck attaching section 32. The lower ends of the yieldable sections 30 are each provided with mounting feet 34 that enable the springs 16 to be secured to the cross rails 22 or the end rails 20 by staples 35 or other common fasteners. The mounting feet 34 are also provided with anti-rotation bars 36. By extending from the mounting feet 34 at an angle relative thereto, the anti-rotation bars 36 operate to prohibit lateral movement or rotation of the springs 16 about an axis defined by the mounting feet 34. When properly incorporated into the box spring assembly 10, the yieldable sections 32 of the illustrated embodiment will extend in a substantially vertical plane between the deck attaching section 32 and the mounting feet 34.

By limiting deflection within a substantially vertical plane, the yieldable sections 30 provide the box spring assembly 10 with an effective firmness that simulates that of a nonspring foundation structure while significantly improving deformation resistance under normal abuse conditions. In accomplishing the above, the yieldable sections 30 of the illustrated embodiment are provided with a middle or arcuate portion 38 located between upper and lower columns 40 and 42. In the preferred embodiment, the arcuate portions 38 are located approximately mid-way between the deck attaching section 32 and the mounting feet 34 so that the upper and lower columns 40 and 42 have approximately the same length. The upper and lower columns 40 and 42 are substantially straight and are oriented so as to be substantially aligned with one another along a common vertical axis.

The arcuate portions 38 are designed for minimal deflection under normal working loads and form a break in the straight line defined by the upper and lower columns 40 and 42. When the spring 16 is loaded, the upper and lower columns 40 and 42 will move generally toward one another and substantially remain in the vertical plane as the arcuate portion 38 bends in resistance to the load. Preferably, the arcuate portions 38 are semicircular or "C" shaped to avoid developing any areas of stress concentration that might weaken the support spring 16. It should be understood, however, that alternate arcuate shapes could be used. While the construction discussed above is preferred, specific design considerations of the box spring assembly 10 will dictate whether the yieldable sections 30 incorporate a design intended to achieve added firmness or an alternate design where deflection is not as restrained.

As best seen in FIG. 2, the yieldable sections 30 are mirror images of each other and the deck attaching section 32 extends generally transversely from the upper end of one yieldable section 30 to the directly opposite upper end of the other yieldable section 30. In so doing, the deck attaching section 32 is provided with a pair of axially directed end bars 44. The end bars 44 extend in the same general direction generally perpendicularly from the upper columns 40 and, as further detailed below, a cross bar extends generally transversely between the terminal or opposing ends of the end bars 44. As will also become apparent from the discussion which follows, the cross bar can have numerous configurations. One limitation, however, is that the cross bar must extend from portions-of the end bars 44 which are generally opposite from one another and to the same side of the yieldable sections 30.

In the illustrated embodiment, the cross bar includes transverse or first portions 46 which extend generally perpendicularly from immediately opposite ends of the end bars 44 toward one another. Axial or second portions 48 extend generally perpendicularly from the first portions 46 so as to be located between and be generally parallel with the end bars 44. A third portion 50 transversely extends between the second portions 48 and connects them together. The third portion 50 is generally perpendicular to the second portions 48 and parallel to both the first portions 46 and the cross wires 28. As such, it can be seen that the cross bar is a hat shaped portion of the deck attaching section 32 and the second and third portions 48 and 50 cooperate to form an axial extension from the first portions 46 between the end bars 44. As shown and described, the axial direction is lengthwise of the assembly 10 and in the general direction of the long wires 26.

Instead of the hat-shape described above, alternate constructions for the cross bar could be employed. For example, the cross bar could extend diagonally from each end bar 44 to form the extension or the cross bars could extend straight between the end bars 44 without an axial extension. It is believed, however, that the spring 16 will be more securely held to the deck 14 if the axial extension is provided.

The length of the cross bar (or width of the spring 16) is provided so that the deck attaching section 32 will extend across at least two and preferably three of the long wires 26 when mounted to the deck 14. To mount the spring 16 to the deck 14, the spring is placed on the deck 14 so that it extends across three of the long wires 26 with the yieldable sections 30 and end bars 44 being outwardly adjacent to the two outermost of the three long wires 26. The spring 16 is also positioned so as to be generally to one side of a cross wire 28. This locates the spring 16 between two adjacent cross wires 28. Thus, the initially mounted spring 16 would be positioned as shown in phantom in FIG. 2 and designated at 52. The entire spring 16 is then moved axially along the long wires 26 in the direction of the arrows 54 toward the cross wire 28. Upon engaging the cross wire 28, the end bars 44 are caused to pass below and contact the lower surface of the cross wires 28 while the axial extension (the second and third portions 48 and 50) of the cross bar extends over the top of the cross wire 28 and contacts its upper surface. As such, the deck attaching section 32 is interwoven with the cross wire 28 firmly clamping the spring 16 to the deck 14. If desired, the end bars 44 can be provided with downwardly directed notches 56 that will receive the cross wire 28 to further positively retain the spring 16 in position relative to the cross wire 28.

The support springs 16 can be variously spaced in the box spring assembly 10 to provide the box spring assembly 10 with a desired amount of support in specific areas. In FIG. 1, the box spring assembly 10 is provided with support springs 16 evenly spaced throughout its construction and the box spring assembly 10 exhibits substantially equal firmness throughout. Alternative positioning and spacing of the springs 16 to achieve the desired firmness is also possible.

While the above description constitutes the preferred embodiments of the present invention, it will be appreciated that the invention is susceptible to modification, variation and change without departing from the proper scope and fair meaning of the accompanying claims.

I claim:

1. In a box spring assembly having a support deck, a frame and a plurality of spring, modules, said support deck being generally rectangular and including a border wire and a wire grid, said border wire extending around and defining a perimeter of said deck, said wire grid being mounted to said border wire and defined thereby, said wire grid including a plurality of straight wires arranged in crisscross fashion, said straight wires including a plurality of long wires extending lengthwise in said assembly and a plurality of cross wires extending crosswise in said assembly, said frame being generally rectangular and including side rails, end rails and cross rails, said side rails and end rails defining a perimeter of said frame and said cross rails extending transversely between said side rails, said plurality of spring modules mounted between said frame and said deck to yieldably support said deck a predetermined distance above said frame, said spring modules including a pair of yieldable sections extending upward from said frame to said deck, the improvement comprising a deck attaching section extending between upper ends of said yieldable sections, said deck attaching section including a pair of end bars extending in the same general direction from said yieldable sections and terminating in terminal ends which are spaced apart and located to one side of said yieldable sections, a cross bar extending between said terminal ends of said end bars, said deck attaching section being configured to engage one of said straight wires in an interwoven fashion in response to movement of said spring module in a direction transverse to said one of said straight wires, said one of said straight wires being interwoven with said deck attaching section such that said one of said straight wires extends over said end bars and under said cross bar.

2. A box spring assembly as set forth in claim 1 wherein said one of said straight wires is a cross wire.

3. A box spring assembly as set forth in claim 2 wherein said deck attaching section engages said deck such that said cross bar extends across at least two long wires.

4. A box spring assembly as set forth in claim 1 wherein said deck attaching section is configured to engage three long wires and one cross wire, said three long wires being located between said end bars when said spring module is engaged with said deck.

5. A box spring assembly as set forth in claim 1 wherein said cross bar includes an extension portion, said extension portion being located over top of said one of said straight wires and extending in a direction generally transverse to said one of said straight wires.

6. A box spring assembly as set forth in claim 1 wherein said end bars include notch-like bends formed therein, said notch-like bends receiving said one of said straight wires therein.

7. A box spring assembly as set forth in claim 6 wherein said notch-like bends face upwardly.

8. A box spring assembly as set forth in claim 1 wherein said end bars are generally transversely oriented with respect to said one of said straight wires.

9. A box spring assembly as set forth in claim 1 wherein said end bars are substantially parallel to said long wires and wherein said cross bar includes a pair of first portions extending from said end bars in a direction generally parallel with said cross wires, a pair of second portions extending from said first portions in a direction generally parallel to said end bars and said long wires, and a third portion extending in a direction generally parallel to said first portions and said cross wires so as to interconnect said second portions.

10. A box spring assembly comprising:

a generally rectangular support deck including a border wire extending around and defining a perimeter of said deck, said deck also including straight wires arranged in crisscross fashion and secured to said border wire, said straight wires including a plurality of long wires extending lengthwise in said assembly and a plurality of cross wires extending crosswise in said assembly;

a generally rectangular frame including side rails, end rails and cross rails, said side rails and end rails defining a perimeter of said frame and said cross rails extending transversely between said side rails; and a plurality of spring modules mounted between said frame and said deck to yieldably support said deck a predetermined distance above said frame, said spring modules including a pair of yieldable sections extending upward from said frame to said deck and a deck attaching section extending between opposing upper ends of said yieldable sections, said deck attaching section being configured to engage one of said cross wires in an interwoven fashion in response to movement of said spring module in a direction transverse to said one of said cross wires, said deck attaching section including a pair of end bars, said end bars extending from each of said yieldable sections generally in the same direction transverse to said one of said cross wires and terminating in terminal ends, said end bars also being located substantially adjacent to one of said long wires and having said one of said cross wires extending thereover so that said terminal ends are to one side of said one of said cross wires, a cross bar transversely extending between said terminal ends of said end bars, said cross bar including a pair of first portions extending from said opposing ends of said end bars in a direction generally parallel to said one of said cross wires, a pair of second portions extending from said first portions in a direction generally parallel to said end bars and said long wires, and a third portion extending in a direction generally parallel to said first portions and said one of said cross wires so as to interconnect said second portions, said one of said cross wires extending beneath said second portions of said cross bar.

11. A method of assembling a box spring assembly which includes a rectangular generally horizontally disposed frame having end rails, side rails and cross rails, said cross rails being substantially parallel to one another and extending generally perpendicularly between said side rails, a rectangular generally horizontally disposed support deck substantially corresponding in size to said frame and being supported a predetermined distance above said frame, said deck having a border wire, cross wires and long wires, said cross wires and said long wires being crisscrossed so as to overlap each other and said cross wires being positioned directly above and substantially parallel to said cross rails, a plurality of spring modules mounted on said cross rails and yieldably supporting said deck said predetermined distance above said frame, each of said spring modules having a pair of substantially upright yieldable portions and a deck attaching portion extending between upper ends of said yieldable portions, said deck attaching portion including a pair of generally spaced apart end bars being interconnected by an integral cross bar, said method comprising the steps of:

locating said spring module on said deck between two adjacent cross wires;

positioning said attaching portion so as to extend across at least two of said long wires with said end bars being positioned outwardly of said at least two long wires;

moving said spring module in a longitudinal direction toward one cross wire such that said end bars move in a direction generally axial with said long wires and generally transverse to said cross wires;

engaging said spring module with said one cross wire so as to be interwoven therewith and effect a clamping of said spring module to said deck; and securing a lower end of said yieldable portions to said frame.

12. The method of claim 11 wherein said one cross wire is interwoven with said end bars and said cross bar such that said one cross wire extends over said end bars and under said cross bar to thereby effect a clamping of said spring module to said deck.

13. The method of claim 11 wherein said end bars are in contact with a lower surface of said one cross wire.

14. The method of claim 11 wherein said cross bar is in contact with an upper surface of said one cross wire.

15. The method of claim 11 further comprising the step of forming a notch in each of said end bars and positioning said one cross wire in said notch of each of said end bars.

16. The method of claim 14 wherein said notches are upwardly facing.

* * * * *